United States Patent [19]

Hayes, Sr. et al.

[11] Patent Number: 4,964,811

[45] Date of Patent: Oct. 23, 1990

[54] ELECTRICAL JUNCTION CONNECTOR HAVING WIRE-RECEIVING SLOTS

[75] Inventors: Earl J. Hayes, Sr., Mechanicsburg, Pa.; Daniel L. Johnson, Kernersville; Galen M. Martin, Greensboro, both of N.C.

[73] Assignee: AMP Incorporated, Harrisburg, Pa.

[21] Appl. No.: 366,870

[22] Filed: Jun. 20, 1989

Related U.S. Application Data

[63] Continuation in part Ser. No. 236,584, Aug. 25,1988 now abandoned.

[51] Int. Cl.[5] ..... H01R 4/24

[52] U.S. Cl. ..... 439/398; 439/402

[58] Field of Search ..... 439/391–407, 439/786, 787, 788, 789

[56] References Cited

U.S. PATENT DOCUMENTS

| | | | |
|---|---|---|---|
| 3,369,210 | 2/1968 | Menickella | 439/787 |
| 3,594,714 | 7/1971 | Paullus et al. | 439/787 |
| 3,854,114 | 12/1974 | Kloth et al. | 439/398 |
| 4,116,522 | 9/1978 | Reynolds | 439/787 |
| 4,258,973 | 3/1981 | Reynolds et al. | 439/395 |
| 4,548,459 | 10/1985 | Mosser | 439/395 |
| 4,580,863 | 4/1986 | Lohr et al. | 439/787 |
| 4,834,670 | 5/1989 | Rodondi et al. | 439/398 |

*Primary Examiner*—David L. Pirlot

*Attorney, Agent, or Firm*—Robert W. Pitts

[57] ABSTRACT

A connector assembly for commonly connecting a plurality of wires comprises a stamped and formed one-piece electrical connecting device having a plurality of U-shaped members arranged in two parallel rows. The opposed edges of adjacent U-shaped members define wire-receiving slots. The U-shaped members have arms which have openings therein forming beams in each of the arms which are deformed in a controlled manner when wires are inserted into the slots. A housing assembly is also disclosed comprising a housing body and a cover. When the cover is assembled to the housing body, the wires are inserted into the slots and the wires are clamped by the cover and the housing body.

15 Claims, 11 Drawing Sheets

10
6
9
9
50
64
56
66
80
78
10
76

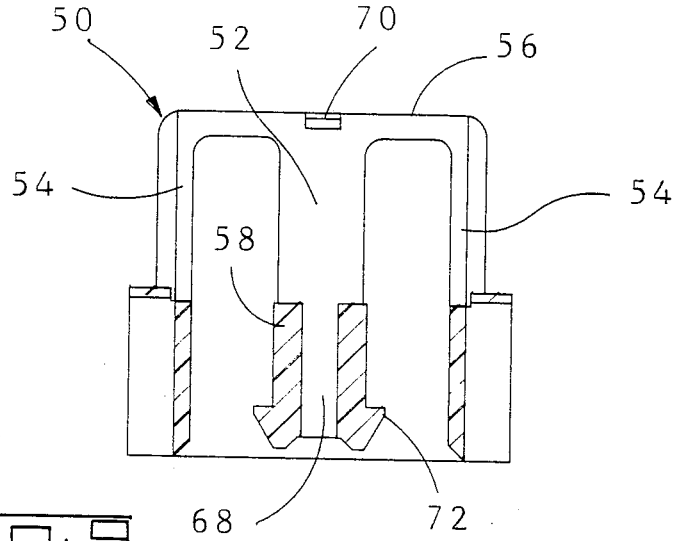
Fig. 9
Fig. 10
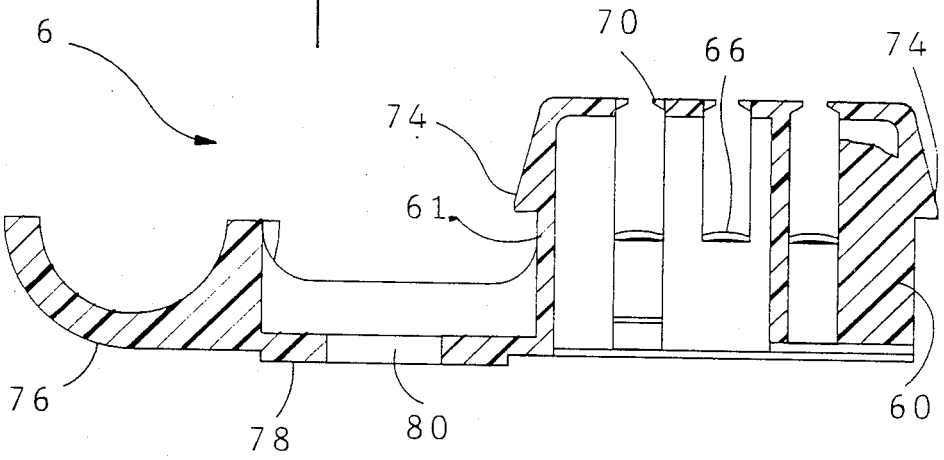

Fig. 11
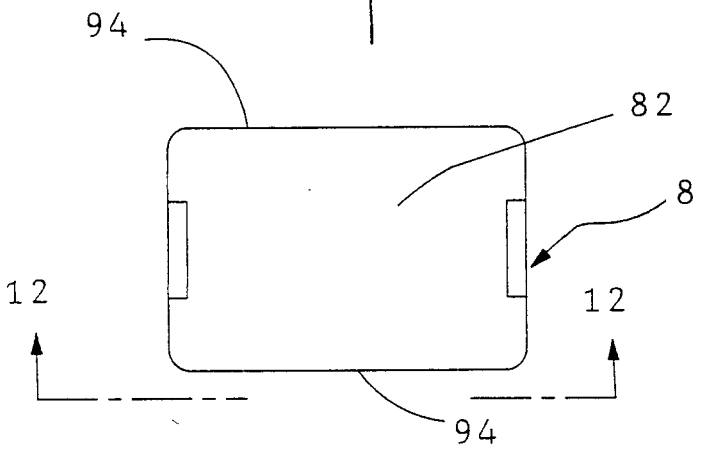
Fig. 12
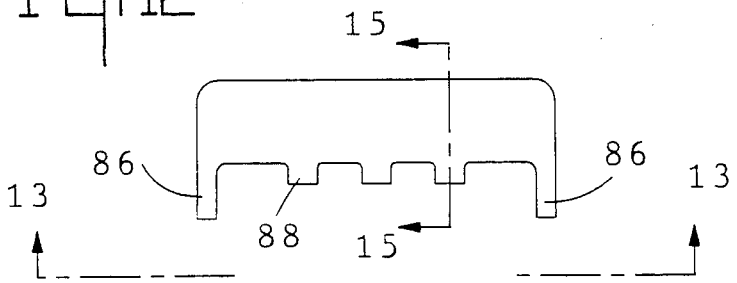
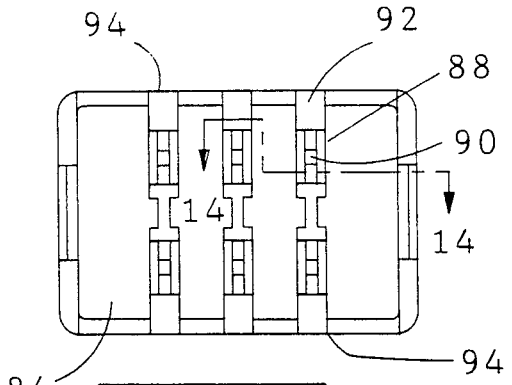
Fig. 13

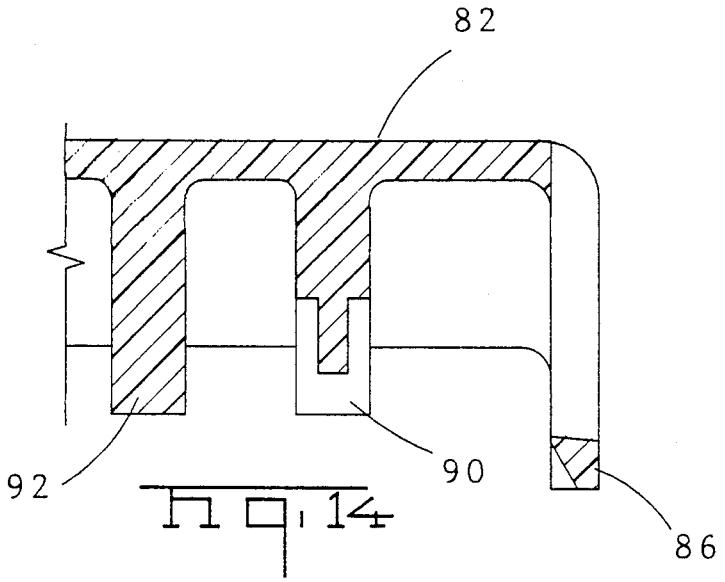
Fig. 14
Fig. 15
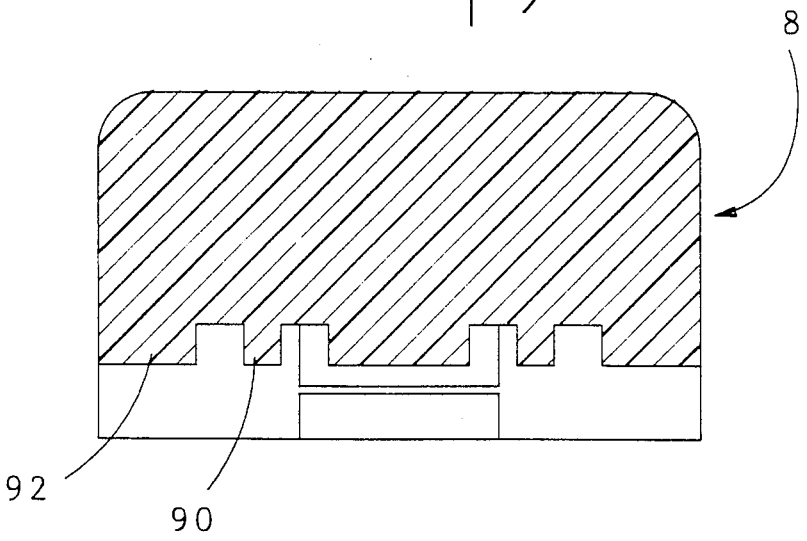

ELECTRICAL JUNCTION CONNECTOR HAVING WIRE-RECEIVING SLOTS

CROSS REFERENCE TO RELATED APPLICATION

This application is a continuation-in-part of application Ser. No. 236,584 filed Aug. 25, 1988 now abandoned.

FIELD OF THE INVENTION

This invention relates to electrical connecting devices of the type having wire-receiving slots and particularly to a junction type or commoning connector having slots for receiving a plurality of wires. The invention further relates to improved features in wire-receiving slots and to the provision of insulating housings for connectors having wire-receiving slots.

BACKGROUND OF THE INVENTION

U.S. Pat. No. 4,227,763 describes a connecting device having a plurality of wire-receiving slots therein for commonly connecting a plurality of wires which extend to an electrical junction. The metallic connecting device is contained in an insulating housing which is, in turn, mounted on a suitable surface. If the commonly connected wires must then be connected to a further conductor, for example, to an electrical ground, it is necessary to provide an additional wire extending from the connecting device to the ground. The insulating housing is always required in the connector shown in the above-identified patent in order to support the metallic connecting device whether or not the insulator is required for other purposes, particularly to insulate the conductive connector contained within the housing.

The present invention is directed to the achievement to an improved commoning connector or connecting device which can be directly mounted on a grounding surface and which, by virtue of its being mounted on the surface, establishes electrical contact therewith. The invention is further directed to the achievement of an improved connecting device having features which permit it to be of relatively small overall dimensions with respect to the number of wires connected and which render it capable of accommodating a relatively wide range of wire sizes.

THE INVENTION

The invention comprises a stamped and formed sheet metal connecting device for commonly connecting a plurality of wires. The device is of the type having wire-receiving slots for the wires, the slots having opposed edges which contact the wire upon movement of the wires laterally of their axes and into the slots. The device comprises two rows of U-shaped members, each member comprising a bight and first and second arms extending from the bight. The U-shaped members of each row are in spaced apart aligned relationship, the first arms in each row being coplanar and the second arms in each row being coplanar. The first and second arms of adjacent U-shaped members in each row have opposed edges which define the wire-receiving slots. Each row has first and second connecting sections which extend for the length of the row. The first and second arms of each U-shaped member have ends which are integral with the associated first and second connecting sections respectively. The first arms of corresponding U-shaped members in the two rows are opposed and proximate to each other and the second arms are remote from each other and face outwardly in opposite directions. The two rows of U-shaped members are connected to each other by a web which extends from one of the connecting sections of one of the rows to the corresponding connecting section of the other row. A molded insulating housing body is provided for covering the connecting device, the housing body having openings which are in registry with the wire-receiving slots.

The molded housing body comprises a plurality of E-shaped sections in aligned relationship in a row. Each section has a central leg, outer legs on each side of the central leg, and a transverse back member from which the legs extend. The central legs are received between the first arms of the associated U-shaped members and the outer legs extend beside the second arms of the associated U-shaped members in the two rows. Each E-shaped section is in covering relationship with a pair of aligned corresponding U-shaped members, the E-shaped sections being spaced apart to permit movement of wires into the slots of the connecting device. The central legs have outer ends which are integral with a continuous central frame, or rib member, which extends for the length of the device between the ends thereof.

In the preferred embodiment, a housing cover is provided for the housing body, the housing cover extending over the transverse back portions of the E-shaped members and has spaced apart wire-inserting ribs on one surface thereof which is against the transverse back members when the cover is assembled to the housing body. The housing body has resilient deformable wire supporting surfaces between adjacent E-shaped members and the housing cover has clamping ribs which are against these surfaces when the cover is on the body. The ribs and the deformable wire supporting surfaces serve as a wire clamping and strain relief means and the deformable surfaces also accurately position the wire so that it is located in a predetermined location in the wire-receiving slot of the connecting device. In accordance with a further aspect thereof, the invention comprises a sheet metal connecting device, which may take a variety of forms, for forming an electrical connection with a wire, the device comprising a plate-like member having a wire-receiving end and a wire-receiving slot extending into the wire-receiving end, the width of the slot being less than the diameter of the wire. The device is characterized in that the slot has an entrance portion at the wire-receiving end, an inner end, and a central portion. The entrance portion and the inner end portion are relatively wider than the central portion. The plate-like member has a pair of oval-shaped openings therein, one opening being provided on each side of the wire-receiving slot. Each opening has a major axis which extends parallel to the slot and a minor axis which extends normally of the slot. Portions of the plate-like member which are between the openings and the slot function as beams having fixed ends, the fixed ends being proximate to the entrance portion and the inner end of the slot. The beams extend from their fixed ends to their central portion towards each other and have a controlled width as measured between the edges of the slot and the openings such that after insertion of a wire into the slot, the beams are flexed by the wire and contact forces on the wire are maintained by the flexed beams so that the plate-like member is otherwise essentially unflexed and unstressed.

THE DRAWING FIGURES

FIG. 3 is a top plan view of the metallic connecting device.

Figure 4:
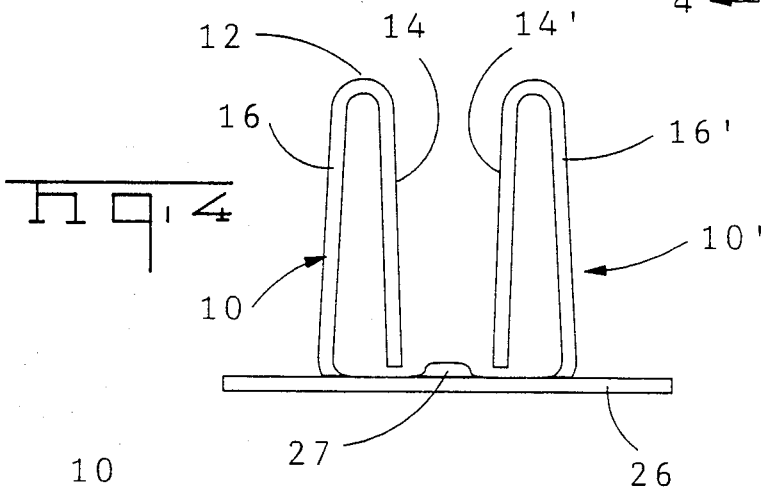
Figure 5:
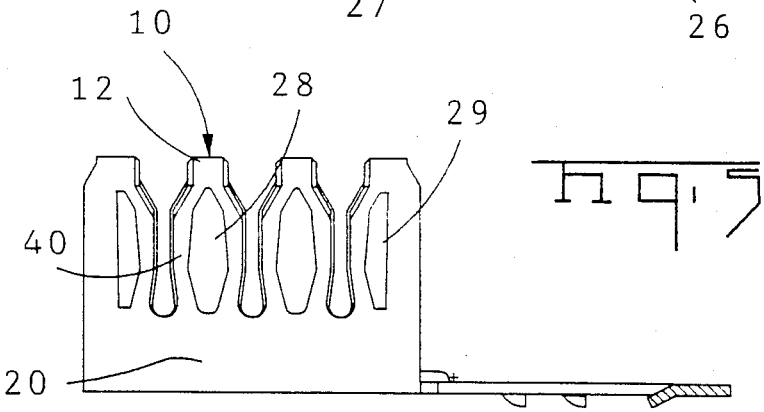
Figure 6:
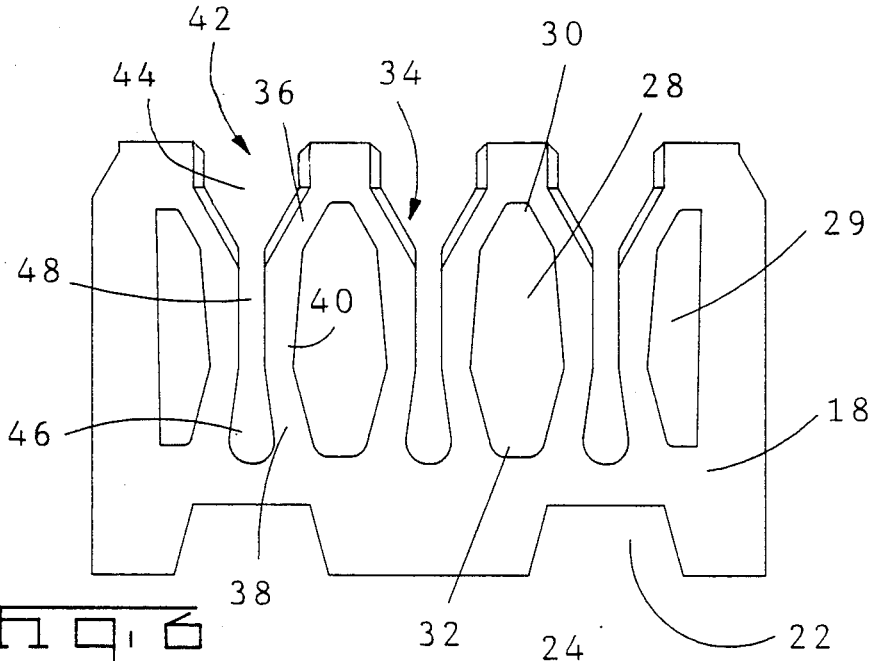
Figure 7:
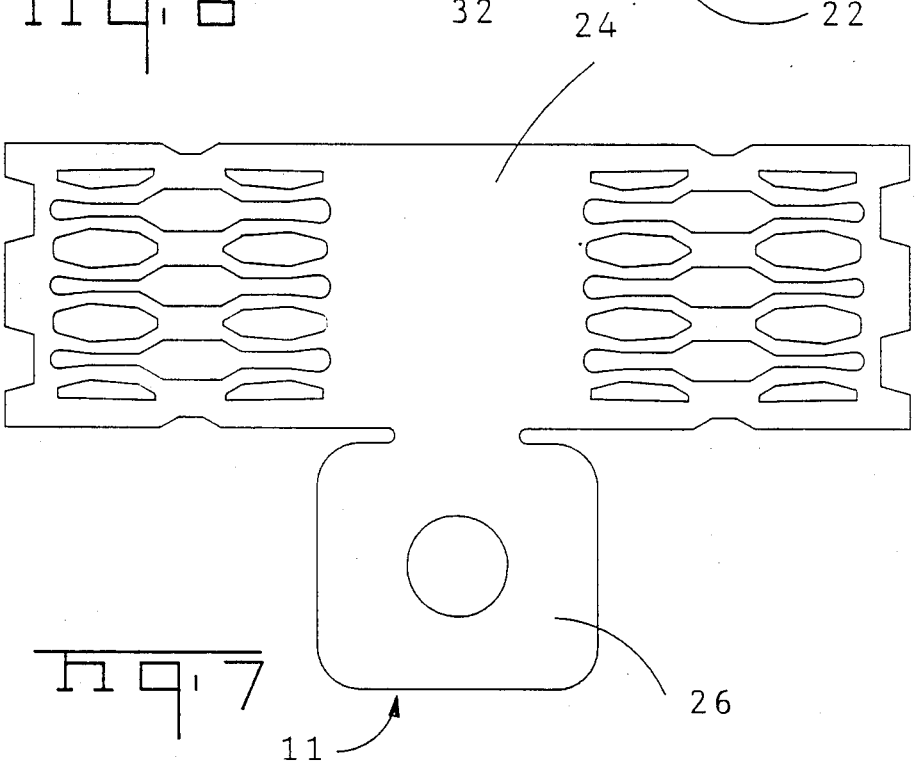

FIGS. 4, 5, and 6 are views looking in the direction of the arrows 4—4, 5—5, and 6—6 of FIG. 3.

Figure 7:
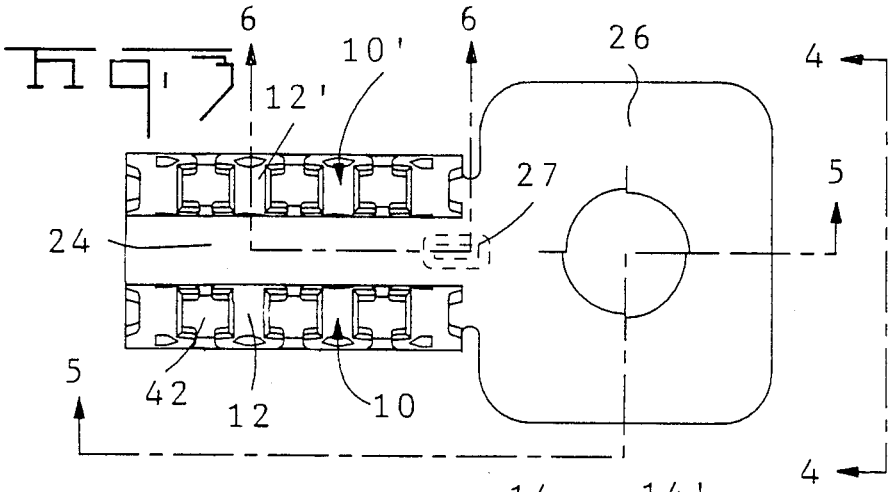

FIG. 7 is a plan view of the flat stamped blank from which the connecting device is formed.

Figure 8:
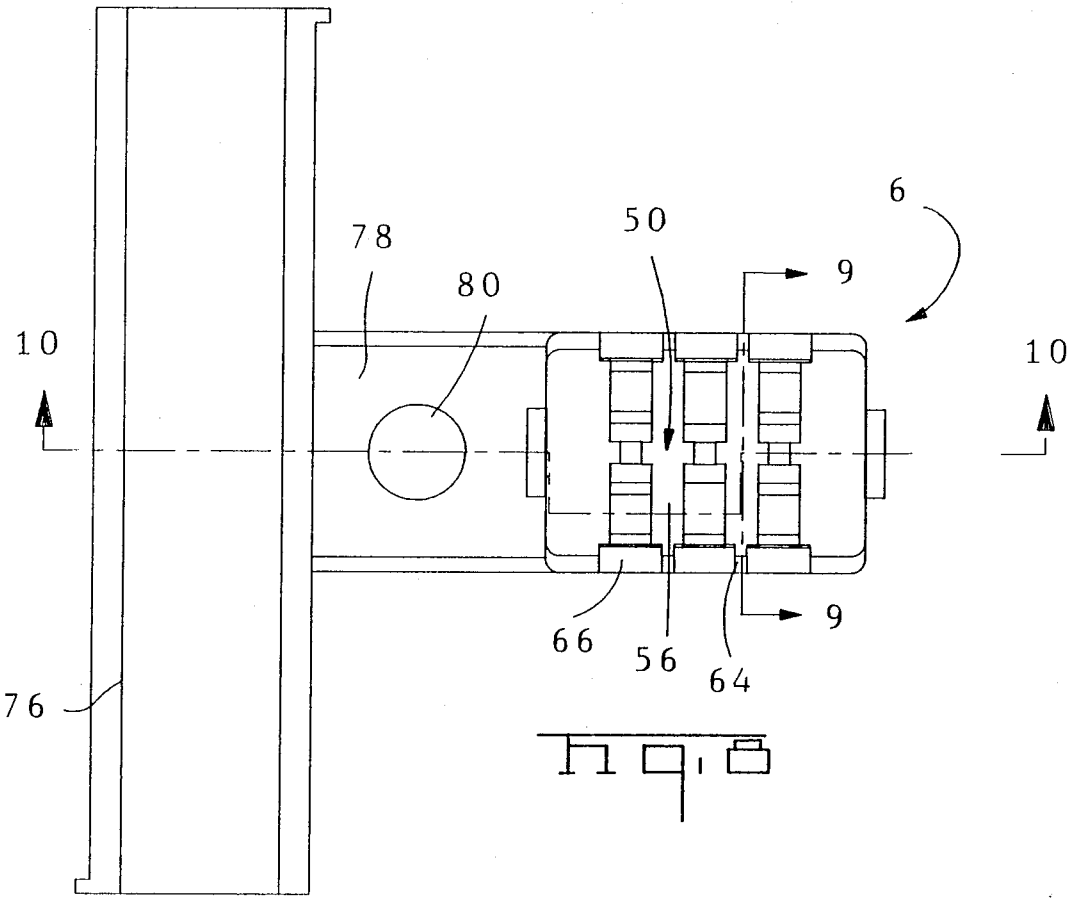

FIG. 8 is a top plan view of the insulating housing for the connecting device.

Figure 10:
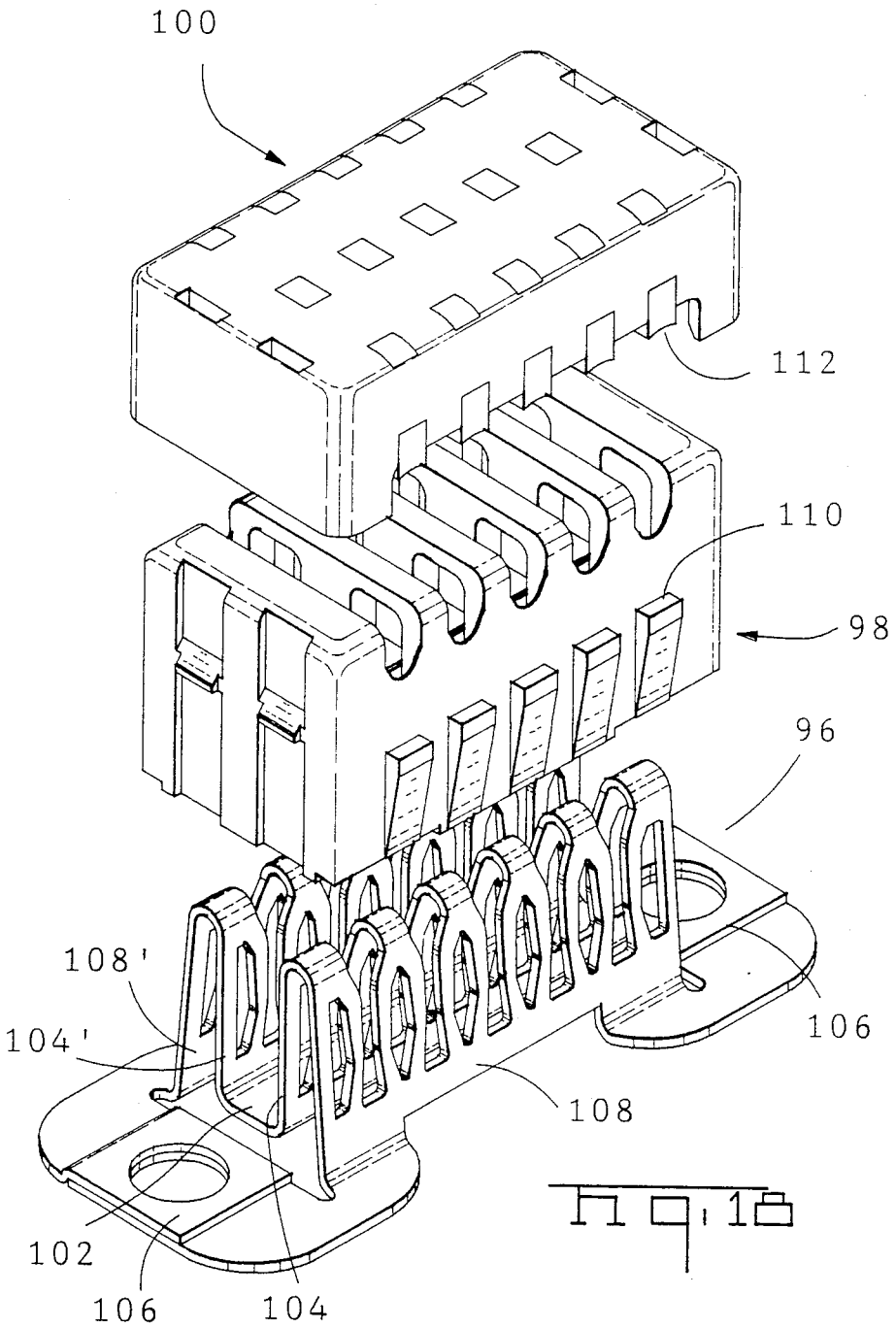

FIGS. 9 and 10 are views looking in the direction of the arrows 9—9 and 10—10 of FIG. 8.

FIG. 11 is a top plan view of the housing cover.

FIG. 12 is a side view looking in the direction of the arrows 12—12 of FIG. 11.

FIG. 13 is a view of the underside of the cover looking in the direction of the arrows 13—13 of FIG. 12.

FIGS. 14 and 15 are sectional views looking in the direction of the arrows 14—14 and 15—15 of FIGS. 13 and 12, respectively.

Figure 16:
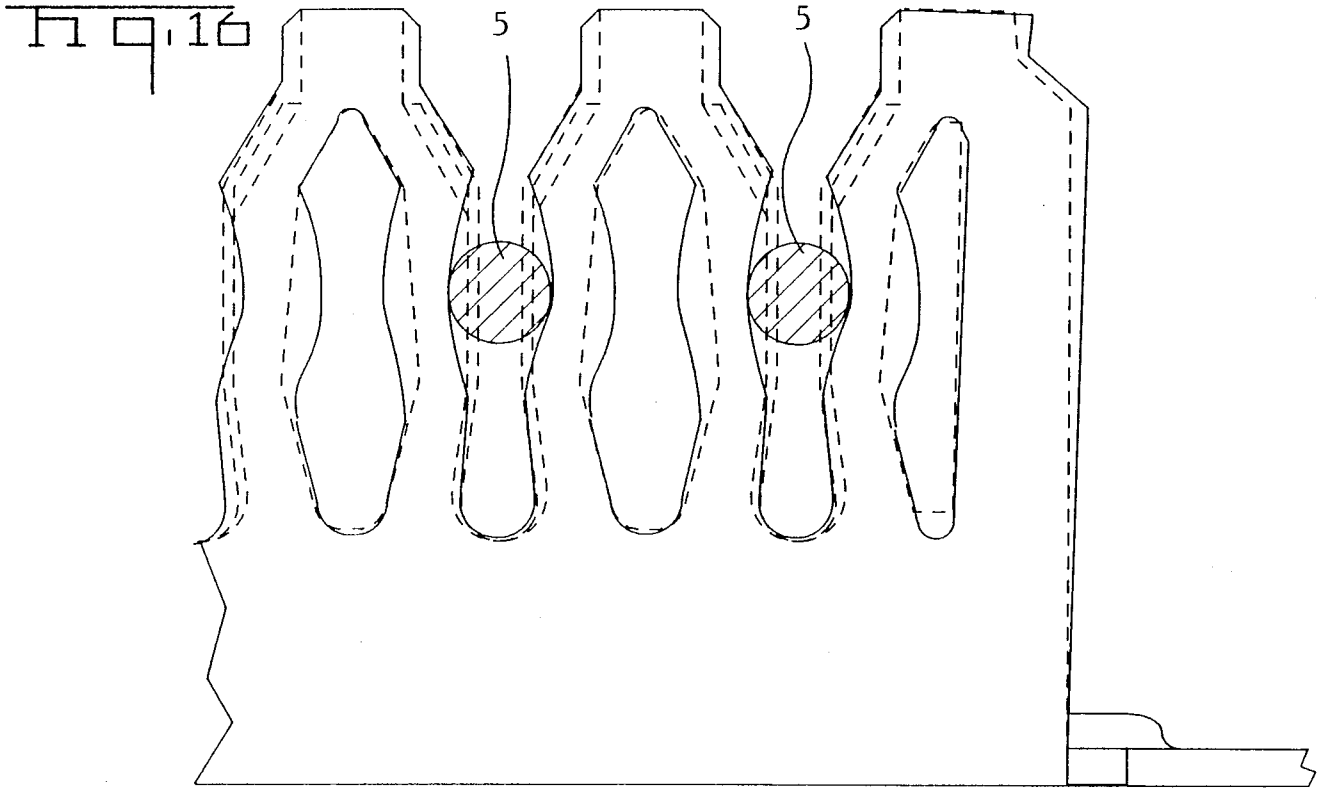
Figure 17:
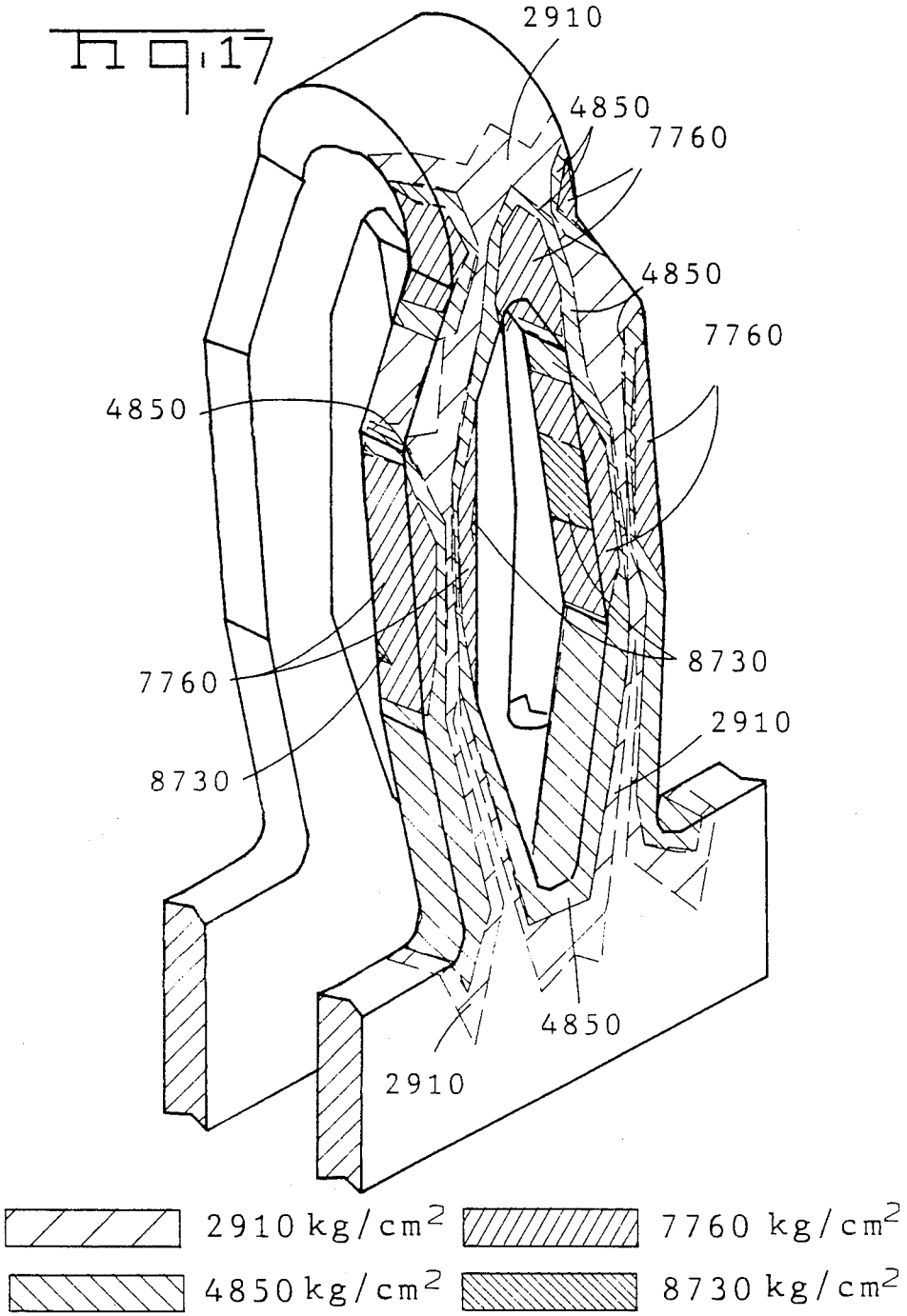

FIGS. 16 and 17 are computer-generated representations of portions of the connecting device which illustrate the manner in which the connecting device is flexed or deformed and which show the levels of stress in the connecting device when wires are inserted into the wire-receiving slots thereof. These views are not based on actual physical test data but are rather the result of a finite element analysis of the device.

FIG. 18 is a perspective exploded view of a connector assembly in accordance with an alternative embodiment.

THE DISCLOSED EMBODIMENT

Figure 1:
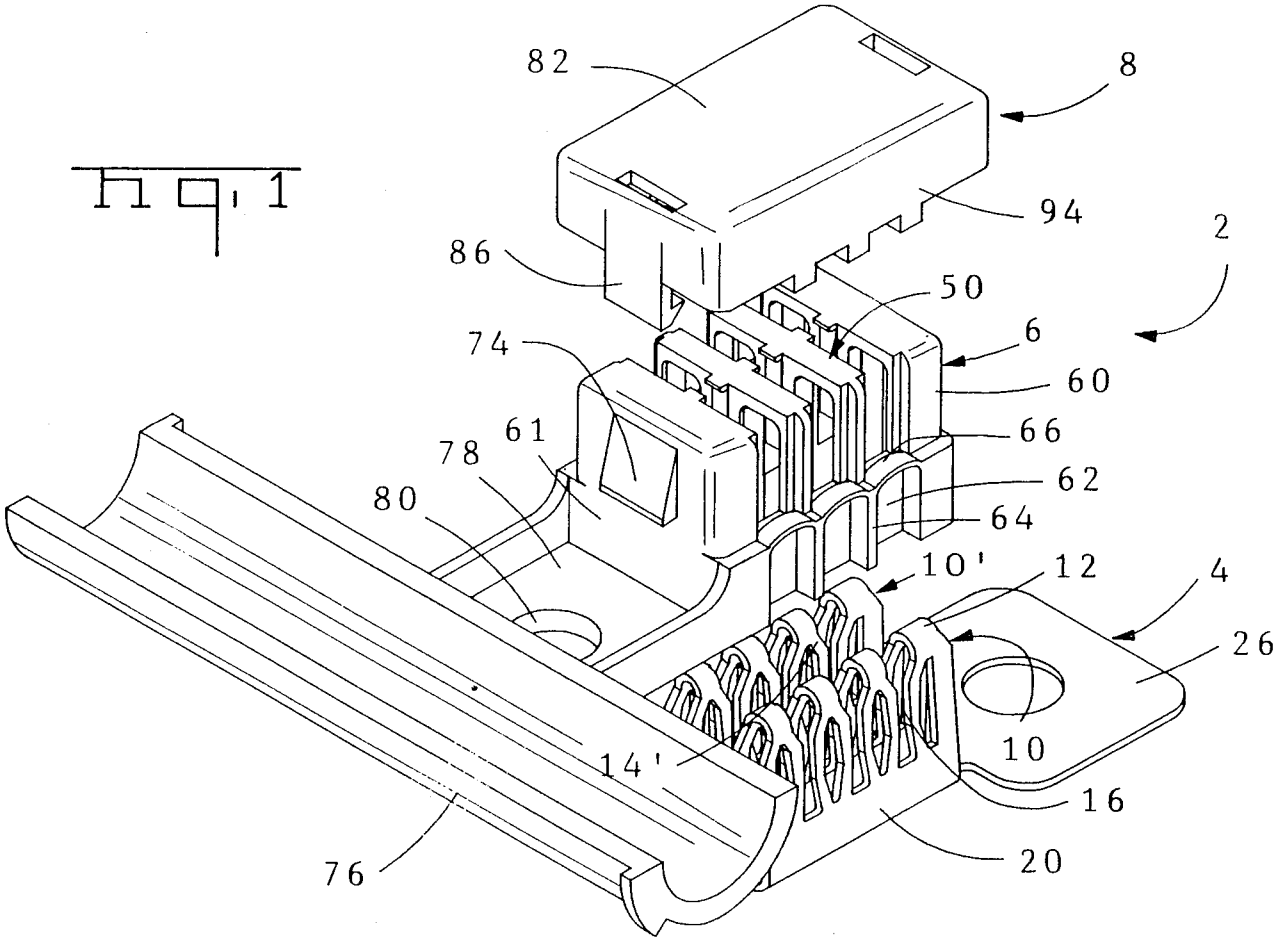
FIG. 1 is a perspective view with the parts in exploded aligned relationship of a connector assembly in accordance with the invention.
Figure 2:
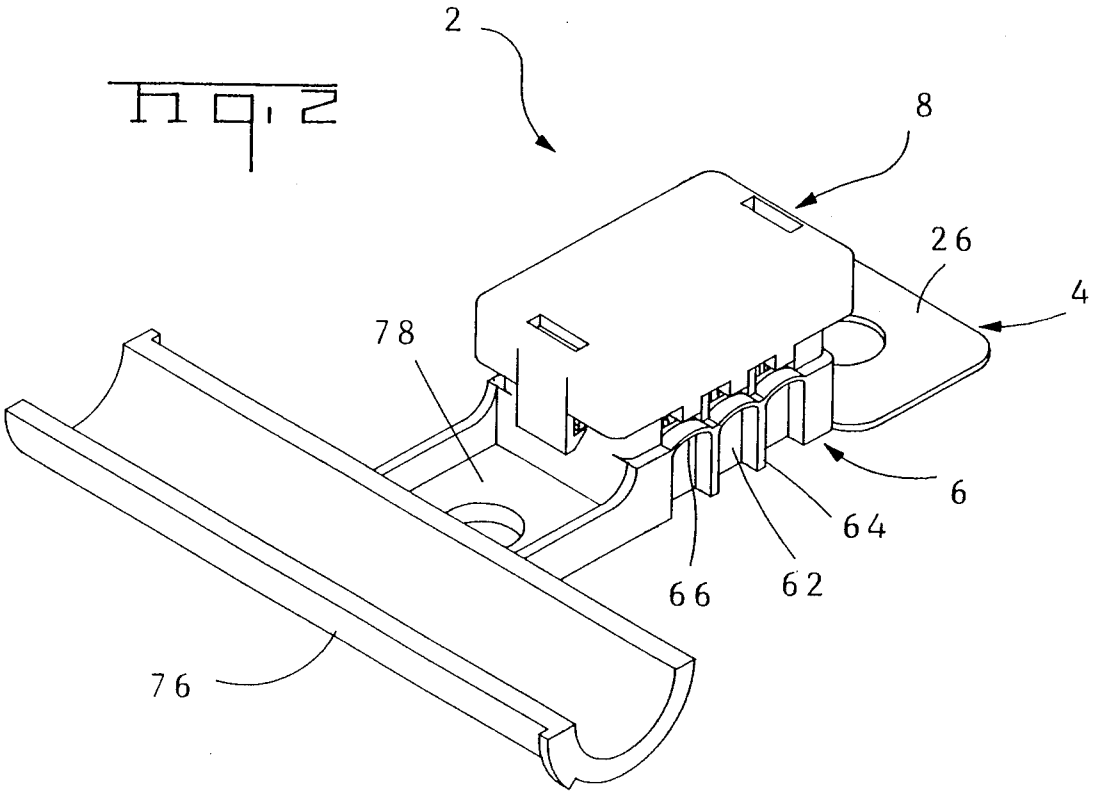
FIG. 2 is a view similar to FIG. 1 showing the parts assembled to each other.

As shown in FIGS. 1 and 2, a connector assembly 2, in accordance with the invention, comprises a stamped and formed connecting device 4, an insulating housing body 6, and a housing cover 8.

The connecting device 4, FIGS. 3–7, comprises two rows of U-shaped members, 10, 10' which are in side-by-side relationship with corresponding U-shaped members in the two rows in alignment with each other. The U-shaped members in the two rows are substantially identical and a description of one will suffice for both. The device is formed from a flat blank 11, FIG. 7.

Each U-shaped member has a bight 12 and first and second arms 14, 16 extending from the bight. The first arms 14, 14' in the two rows are opposed to, and proximate to each other and the second arms 16, 16' are remote from each other and face in opposite directions. The first arms have their outer ends integral with a first connecting section 18 and the second arms have their outer ends integral with a second connecting section 20. The first connecting section 18 has spaced-apart notches 22 in its lower edge for cooperation with latching means on the housing cover. The two rows of U-shaped members are connected to each other by a flat web 24 which extends between the second connecting sections 20, 20'. An ear 26 extends from the web at one end of the device and has an opening therein for securing the device to a grounding surface. A dimple may be provided as shown at 27 adjacent to the ear to stiffen the web in the vicinity of the ear.

Each of the first and second arms has an oblong, generally oval-shaped opening therein 28 excepting the arms at the end which have openings 29. Each opening 28 has an upper end 30 and a lower end 32, the openings having a major axis which extends between the ends and a minor axis which extends transversely of the major axis. The openings are somewhat irregular in shape and their configuration determines the manner in which the device is stressed as will be described below.

The openings define beams 34, each beam having fixed upper and lower ends 36, 38 and an intermediate portion 40. The fixed ends are proximate to the bight 12 and the adjacent connecting section 18 or 20, respectively and the beams extend somewhat laterally in their central portions towards the corresponding or adjacent beam of an adjacent U-shaped section. The opposed edges of adjacent beams 34 in adjacent U-shaped members 10, 10' define the wire-receiving slots 42. Each slot has a relatively wide entrance 44 and a relatively wide enlarged inner end 46. The intermediate portion 48 of each slot is relatively narrow and it is in this intermediate portion of the slot that the wire is held after it has been inserted.

The U-shaped members at the ends of each row have openings 29 which are about one-half the size of the openings 28 which are provided in the intermediate U-shaped members. The U-shaped members at the ends of the rows have only one beam and it is preferable to reduce the size of the openings in order that the end U-shaped members will have maximum strength. The wire-receiving slots 42 between adjacent first arms 14, 14' are preferably more narrow in their central portions 48 than the slots between adjacent second arms 16, 16' so that the device will be capable of accommodating a range of wire sizes. In other words, the slots in the second arms may have a width such that contact will be established with a relatively heavier gauge wire than the slots between the beams of adjacent first arms. The oversized wires may overstress the beams in the first arms 14, 14' but such overstressing would not affect the electrical connection between the inserted oversized wire and the slots between adjacent beams in the second arms 16, 16'.

The device can be produced in any desired size; however, where it is intended for use as a grounding connector for automotive wiring, it is desirable that the size be kept to a minimum. One connecting device in accordance with the invention, for example, has an overall height of only about 13 mm and an overall length, including the ear, of only about 36 mm. The material preferred for a connecting device of this size should preferably have a relatively high yield strength, for example, a beryllium copper alloy having a yield strength of about 96000 psi (6750 $Kg/cm^2$).

The housing body 6, FIGS. 8–10, is molded of a suitable polyester material and comprises a plurality of E-shaped sections 50, each of which has a central leg 52, outer legs 54, and a transverse back member 56 from which the legs extend. The ends of the central legs are integral with a central frame or rib member 58 which extends for the full length of the housing between the end sections 60, 61 thereof. Relatively thin panel sections 62 extend between the end portions of the outer legs and ribs 64 extend outwardly on the sides beyond these panel sections. Integral flexible arches 66 extend between adjacent ribs 64 and provide a wire supporting surface which is flexed, or deformed, when the cover member is assembled to the housing body in order to clamp the wires as will be described below.

The central legs 52 have openings 68 extending centrally therethrough from their outer ends. These openings reduce the amount of material in the central legs and in the central rib and additionally permit the molding of integral retaining ears 70 which extend laterally over the space between adjacent E-shaped members. The ears function to retain wires in the housing member prior to assembly of the cover member to the body. The central legs also have latch ears 72 thereon which cooperate with the notches 22 of the connecting device in order to secure the housing body to the metallic connecting device. Additional latch ears 74 are provided on the end sections for cooperation with latch arms on the cover member.

An integral troth-like cable retainer 76 is connected to the end section 61 by a connecting section 78 that has an opening 80 therein for a fastener. A wiring harness can be held in the retainer by a bundle tie or other means. When the device is placed in service, the metallic connecting device 4 is bolted or otherwise secured to a metallic grounding surface but it is also desirable to anchor the housing body 6 independently by means of a fastener so that if a force is applied to the harness which is received in the harness retainer, it will not be transmitted to the housing body but will be borne by the fastener in the opening 80.

The housing cover 8, FIGS. 11–15, is generally rectangular and has an external surface 82, an internal surface 84, and sides 94. Latch arms 86 extend from the ends of the cover and have openings for cooperation with the ears 74 on the body portion. Transverse ribs 88 extend between the sides 94 on the internal major surface 84 and are contoured to provide wire stuffer sections 90 and wire clamping portions 92. When the device is placed in service, the wires are located in the entrance portions of the wire-receiving slots 42 and retained therein by the ears 70 as noted above. Thereafter, when the cover 8 is assembled to the molded body portion 6 of the housing, the stuffer portions 90 of the ribs 88 push the wires in the wire-receiving slots of the connecting device. At the same time, the clamping portions 92 of the ribs clamp the wires against the deformable arches 66 and provide a strain relief for the wires entering the wire-receiving slots. The flexible arches and the wire-clamping portions 92 of the ribs serve the added function of retaining the wires in predetermined locations in the wire-receiving slots; in other words, the wires are prevented from moving downwardly beyond a desired location in the slots which will produce optimum contact pressure as will be discussed below.

FIGS. 16 and 17 are graphical representations which illustrate the behavior of the connecting device, and particularly the beams, when wires 5 are inserted into the wire-receiving slots. These views are not based on physical test data but are rather a result of a finite element analysis of the connecting device and the views themselves were originally produced by the computer. FIG. 16 shows the manner in which the beams will be deformed, the wires 5 having been added to this view in order to indicate their positions. FIG. 17 illustrates the deformation of two individual beams and indicates the actual stress level produced as a result of insertion of the wire. For the finite element analysis, it was assumed that the device was produced from a beryllium copper alloy having a yield strength of about 96000 psi (6750 $Kg/cm^2$). It can be seen from FIG. 17 that the central portions of the beams are stressed at a level higher than the yield strength of the material and the metal in the central portions therefore has been plastically deformed and somewhat work hardened. However, the fixed ends of the beams are not stressed beyond the elastic limit of the material, although the stress at the upper ends of the beams in FIG. 17 is somewhat higher than the stress at the lower ends and localized plastic deformation has taken place at the upper ends. The significance of FIG. 17 is that it shows that, notwithstanding the relatively small size of the device, the contact force can be maintained by the elastically deformed portions of the beams as well as the plastically deformed central portions so that an extremely stable electrical connection will be obtained.

The openings 28 and the beams may take a variety of forms depending upon the material thickness and its elastic limit and the dimensional limitations placed on the designer such as the maximum permissible height of the connecting device. Under many, or most, circumstances, the beams will extend arcuately from their ends to their central portions and the openings 28 will therefore be generally oval shaped but somewhat irregular as shown, for example, by the disclosed embodiment. When a particular connecting device is designed in accordance with the invention, the designer will choose the shape of the openings and fix the other variables such that the ends of the beams are stressed within the elastic limit of the material and material is highly stressed only in the central portions of the beams.

FIG. 18 shows an alternative embodiment comprising a metallic connecting device 96, a housing body 98, and a housing cover 100. The connecting device 96 has a central web 102 which is integral with and extends between the first connecting sections 104 of the first arms of the U-shaped devices or members. The ears 106 in this embodiment are integral with and extend from the second connecting sections 108. The wires are clamped by means of surfaces 110 on the sides of the housing body and resilient clamping portions 112 of the cover. The cover is produced of a relatively firm hard plastic material but the clamping sections are overmolded of a softer material.

Connector assemblies in accordance with the invention are better adapted for stranded wires than most known types of wire in slot connecting devices for the reasons that the strain relief and clamping of the wire by the clamping ribs and arches maintain the strands of the wire in a compacted bundle and prevent migration of the strands, a phenomenon which results in a lowering of the contact force and a resulting increase in electrical resistance. Also, the high contact forces which can be achieved will produce a low resistance connection whether the wire is solid or stranded.

Advantageously, the slots between the inner or first arms 14, 14' are more narrow than the slots between adjacent second or outer arms 16, 16' so that the connecting device is capable of making electrical connections to a range of wire sizes. For example, the slots between the first arms can be of a width such that they will receive wires in the AWG 18–20 range and the slots between adjacent second arms can be such that they will receive wires in the AWG 14–16 range.

A benefit is achieved if the slots between adjacent outer arms are wider than the slots between adjacent inner arms in that the wider slots are closer to the mounting ear than are the slots between adjacent inner arms. The heavier gauge wires which would be connected to the device in the wider slots would carry a higher current than would wires connected by the inner slots and it is desirable that the higher current have the shortest path to the ground connection through the ear. This benefit is achieved with both of the embodiments of the invention.

A connector assembly in accordance with the invention can be produced at relatively low cost by simple manufacturing operations. The connecting device 4 is produced by simple stamping and forming operations and the plastic parts can be manufactured by injection molding operations with a straight action mold; that is, a mold which has all of its core pins extending in the same direction as the directions of the movement of the mold parts when the mold is opened and closed. There is no requirement for core pins which extend transversely of the directions of movement of the mold parts. The latter molding technique requires a more complex mold and is inherently an expensive manufacturing operation.

The type of wire receiving slot used in the invention, having the openings 28 which are on each side of the slot, can be used under circumstances other than those of the disclosed embodiment; for example, in a single plate-like member having a single slot.

We claim:

1. A connector assembly including a stamped and formed sheet metal connecting device for commonly connecting a plurality of wires, the device being of the type having wire-receiving slots for the wires, the slots having opposed edges which contact the wires upon movement of the wires laterally of their axes and into the slots, the device comprising:

two rows of U-shaped members, each U-shaped member comprising a bight and first and second arms extending from the bight, the U-shaped member of each row being in spaced-apart aligned relationship, the first arms in each row being coplanar and the second arms of each row being coplanar, adjacent U-shaped members in each row having opposed edges which define the wire-receiving slots, each row having first and second connecting sections which extend for the length of the row, the first and second arms of each U-shaped member having ends which re integral with the associated first and second connecting sections respectively, the first arms of corresponding U-shaped members in the two rows being opposed and proximate to each other, the second arms being remote from each other and facing outwardly in opposite direction, two rows of U-shaped members being connected to each other by a web which extends from one of the connecting sections of one of the rows to the corresponding connecting section of the other row, and a molded insulating housing body is provided for covering the connecting device, the insulating housing body having openings which are in registry with the wire-receiving slots thereby to permit movement of the wires into the slots, and the molded insulating housing body comprising a plurality of E-shaped sections in aligned relationship in a row, each section having a central leg, outer legs on each side of the central leg, and a transverse back member from which the legs extend, the central legs being received between the first arms of corresponding U-shaped members, the outer legs extending beside the second arms of corresponding U-shaped members in the two rows, each E-shaped section being in covering relationship with a pair of corresponding U-shaped members, the E-shaped sections being spaced-apart thereby to provide the openings which are in registry with the slots, the central legs having outer ends which are integral with a continuous central frame member which extends for the length of the device between the ends thereof.

2. A connector assembly as set forth in claim 1 characterized in that the housing body has end sections at each end of the row of E-shaped sections, the central frame member being integral with the end sections.

3. A connector assembly as set forth in claim 1 characterized in that the web extends between, and is integral with, the connecting sections which are integral with the second arms of the U-shaped members.

4. A connector assembly as set forth in claim 1 characterized in that the outer legs of adjacent E-shaped members are connected by panel members.

5. A connector assembly as set forth in claim 4 characterized in that interengaging means comprising latch ears on the housing body and recesses in the connecting sections of the connecting device are provided for retaining the housing body on the connecting device.

6. A connector assembly as set forth in claim 4 characterized in that a housing cover is provided for the housing body, the housing cover extending over the transverse back members of the E-shaped members, the housing cover having spaced-part wire-inserting ribs on the one surface thereof which is against the transverse back members when the cover is on the housing body, the housing cover and body having interengaging means for securing the cover to the body.

7. A connector assembly as set forth in claim 6 characterized in that the housing body and the housing cover have wire strain relief means in alignment with the wire-receiving slot means.

8. A connector assembly as set forth in claim 7 characterized in that each of the strain relief means comprises a clamping rib on the one surface of the cover and a resilient wire support on the housing body whereby a wire extending through the housing body and into a wire-receiving slot is clamped between the clamping rib and the resilient wire support.

9. A connector assembly as set forth in either of claims 1 or 8 characterized in that each wire receiving slot has an entrance portion, a central portion, and an inner end portion, the entrance portion and the inner end portion being relatively wider than the central portion, each of the connecting device arms having an oval shaped opening therein, each opening having a major axis which extends parallel to the associated slot and a minor axis which extends normally of the slot, the portions of each arm which are between the opening and the adjacent slot means being beams having fixed ends which are proximate to the entrance portion and the inner end portion of the adjacent slot, the beams extending laterally from their fixed ends to their central portions, the beams having a controlled width, as measured between the edges of the slot and the associated opening whereby, after insertion of the wire into the slot, the beams are flexed by the wire and contact forces on the wire are maintained by the flexed beams, and the connector device arms otherwise substantially unstressed.

10. A connector assembly as set forth in claim 1 characterized in that the web extends between, and is integral with, the connecting sections which are integral with the first arms of the U-shaped members.

11. A connector assembly as set forth in claim 10 characterized in that the web has a mounting ear extending therefrom at one end thereof for mounting the device on a grounding surface.

12. A sheet metal connecting device for forming an electrical connection with a wire, the device comprising a plate-like member having a wire-receiving end and a wire-receiving slot extending into the wire-receiving end, the width of a portion of the slot being less than the diameter of the wire, the device being characterized in that:

the slot has an entrance at the wire-receiving end, an inner end and a central portion, the entrance portion and the inner end portion being relatively wider than the central portion, the slot being formed by opposed beams having fixed ends, the fixed ends being proximate to the entrance portion and the inner end of the slot, the beams being tapered from their fixed ends towards their central portions and inclined from their fixed ends to their central portions, the beams having a controlled width, whereby, after insertion of the wire into the slot, the beams are flexed by the wire and contact forces on the wire are maintained by the flexed beams.

13. The sheet metal connecting device of claim 12 characterized in that the plate-like member has a pair of oval shaped openings therein, one opening being provided on each side of the wire-receiving slot, each opening having a major axis which extends parallel to the slot and a minor axis which extends normally of the slot, portions of the plate-like member which are between the openings and the slot comprising the beams.

14. The sheet metal connecting device of claim 13 characterized in that the beams extend generally arcuately from their fixed ends to their central portions.

15. A sheet metal connecting device for forming an electrical connection with a wire, the device comprising a plate-like member having a wire receiving slot, the slot having a wire-receiving end, an inner end, and a central portion, the slot being defined by opposed beams having fixed ends proximate the wire-receiving end and the inner end of the slot, the beams being configured with tapered sections between the fixed ends and the section of the beams adjacent the central portion of the slot, such that upon insertion of a wire into the slot, the sections of the beams adjacent the central portion of the slot are plastically deformed, with the stresses in the fixed ends of the beams adjacent the wire-receiving end and the inner end of the slot remaining generally below the elastic limit.

* * * * *

UNITED STATES PATENT AND TRADEMARK OFFICE

CERTIFICATE OF CORRECTION

PATENT NO. : 4,964,811

DATED : October 23, 1990

INVENTOR(S) : Earl J. Hayes Sr. et al

It is certified that error appears in the above-identified patent and that said Letters Patent is hereby corrected as shown below:

On the title page:

The name "James E. Sumner, Jr. (deceased)" should appear as an inventor.

Claim 1, column 7, line 47-the word "re" should be --are--.

Claim 6, column 8, line 31-the words "spaced-part" should be the words --spaced-apart--.

Signed and Sealed this

Thirteenth Day of October, 1992

*Attest:*

DOUGLAS B. COMER

*Attesting Officer*

*Acting Commissioner of Patents and Trademarks*